US007449827B2

(12) United States Patent
Ito

(10) Patent No.: US 7,449,827 B2
(45) Date of Patent: Nov. 11, 2008

(54) SPACER STRUCTURE FOR IMAGE FORMING APPARATUS

(75) Inventor: Nobuhiro Ito, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 434 days.

(21) Appl. No.: 11/288,189

(22) Filed: Nov. 29, 2005

(65) Prior Publication Data

US 2006/0125374 A1 Jun. 15, 2006

(30) Foreign Application Priority Data

Dec. 9, 2004 (JP) ..... 2004-356502

(51) Int. Cl.
*H01J 1/62* (2006.01)
*H01J 63/04* (2006.01)

(52) U.S. Cl. ..... 313/495; 313/292

(58) Field of Classification Search ..... 313/495–497, 313/238, 292, 310

See application file for complete search history.

(56) References Cited

U.S. PATENT DOCUMENTS

| | | | | |
|---|---|---|---|---|
| 5,939,822 | A | 8/1999 | Alderson | 313/493 |
| 6,353,280 | B1 * | 3/2002 | Shibata et al. | 313/292 |
| 6,600,263 | B1 * | 7/2003 | Ito | 313/495 |
| 6,809,469 | B1 | 10/2004 | Ito et al. | 313/495 |
| 6,963,159 | B2 * | 11/2005 | Fushimi | 313/292 |
| 2003/0141803 | A1 | 7/2003 | Fushimi | 313/495 |

FOREIGN PATENT DOCUMENTS

JP 2000-311632 11/2000

OTHER PUBLICATIONS

Grais, K. et al., "A Study of Secondary Electron Emission in Insulators and Semiconductors," *J. Appl. Phys.*, vol. 53, No. 7, pp. 5239-5242 (1982).

European Communication and Search Report dated Apr. 28, 2008, regarding Application No. 05026405.0-2208.

* cited by examiner

*Primary Examiner*—Karabi Guharay
*Assistant Examiner*—Kevin Quarterman
(74) *Attorney, Agent, or Firm*—Fitzpatrick, Cella, Harper & Scinto

(57) ABSTRACT

In a spacer having concave/convex portions to prevent short-time charging in a flat type image forming apparatus in which an electron source substrate and an anode substrate are arranged so as to face each other through the spacer, the charging upon long-time driving due to the concave/convex portions is suppressed. In the spacer in which the surface of an insulating substrate having a rough surface is coated with a high resistance film, the high resistance film has double layers of a low resistance region locating on the substrate side and a high resistance region locating on the front surface side, and a thickness (t) of high resistance film on the slant surface of each of the concave/convex portions and a thickness (s) of high resistance region are set to ($t \geqq dp+\lambda \geqq s$) for the primary electron penetration length (dp) and the ionization electron diffusion length ($\lambda$).

4 Claims, 5 Drawing Sheets

PARAMETER CALCULATED BASED ON SECONDARY ELECTRON EMISSION COEFFICIENT $\delta(E)$ P = 1.37
Q = 0.0269
m = 64.6
n = 1.65

SPACER STRUCTURE FOR IMAGE FORMING APPARATUS

BACKGROUND OF THE INVENTION

1. Field of the Invention

The invention relates to an image forming apparatus such as a flat type image display apparatus or the like using electron-emitting devices and light emitting members and, more particularly, to the invention having a feature in a spacer which is interposed between an electron source substrate on which the electron-emitting devices are formed and a substrate having the light emitting-members in order to keep a distance between both of those substrates.

2. Related Background Art

Hitherto, as for an image display apparatus including a CRT, a further larger display screen is demanded and it is an important subject to realize a thin size and a light weight of the apparatus in association with the realization of the large display screen. As an image display apparatus which can realize the thin size and light weight, the applicant of the present invention has proposed the flat type image display apparatus using surface conduction electron-emitting devices. According to such an image display apparatus using the surface conduction electron-emitting devices, a rear plate having a plurality of electron emitting devices and a face plate having light emitting members and anode electrodes are sealed through a frame member, thereby forming a vacuum container. In such an image display apparatus, to prevent deformation and destruction of the substrates due to an atmospheric pressure difference between the inside of the vacuum container and the outside, an atmospheric pressure resistance structure called a spacer is interposed between the substrates. Generally, the spacer has a rectangular thin plate shape and is arranged while their edge portions are come into contact with both of the substrates in such a manner that its surface is parallel with the normal direction of the substrates.

A technical problem which the spacer has to satisfy is that not only an element as an atmospheric pressure resistance structure is necessary but also, in order to keep quality of a display image, it is necessary that its existence does not easily exercise an influence on a trajectory of an electron beam. Generally, a factor in which the spacer exerts an influence on neighboring emission electrons is understood as charging of the spacer. Several causes for the charging of the spacer can be mentioned. Fundamentally, it will be understood that a cause in which excess and deficiency of charges occurs due to transfer and reception of the electrons to/from an external region accompanied by incidence and re-emission of the electrons, so that the charging which exercise an influence on the trajectory of the electron occurs. As a technical solving method for the excess and deficiency of charges, there is a method of time-dependently obtaining an attenuating effect of the charge amount by applying electroconductivity to the spacer. As another solving method, there is such a technique that a secondary electron emission coefficient of the surface is set to a value which is not so larger than 1. Specifically speaking, there have been known a technique in which the secondary electron emission coefficient of a surface material which is applied is specified to a range of predetermined values, a technique in which a secondary electron emission amount is suppressed in a shape manner by providing a rough surface (concave and convex portions) for the spacer surface (refer to the specification of U.S. Pat. No. 5,939,822 and Japanese Patent Application Laid-Open No. 2000-311632 (U.S. Pat. No. 6,809,469)), and the like.

The charging which can be suppressed by the conventional method of forming a charge preventing film onto the spacer, forming the surface roughness, or the like is lightened within a non-selecting period of a display driving time. Such charging is instantaneously caused on the spacer surface by the electrons which penetrate into the spacer when the electron-emitting device is driven. That is, it is not a cumulative accumulation of the charges (hereinbelow, the charging charges in the short time and the charging phenomenon are called short time charging charges, short time charging, surface charging charges, or surface charging).

However, in the case where the concave and convex portions are formed on the spacer surface, although the short time charging of the spacer is suppressed, a change in beam spot position is cumulatively observed.

SUMMARY OF THE INVENTION

It is an object of the invention to provide an image forming apparatus that can suppress cumulative charging in a spacer on which a rough surface is formed and which suppresses the short time charging and prevents deterioration in display characteristics due to a change in beam spot position due to such suppression.

According to the invention, there is provided an image forming apparatus comprising:

an electron-source substrate having a plurality of electron-emitting devices and wirings to apply voltages to the electron-emitting devices;

an anode substrate which is arranged so as to face the electron source substrate and has light emitting members each of which emits light by irradiation of an electron emitted from each of the electron-emitting devices and an anode electrode;

a frame which exists in peripheral portions of the electron source substrate and the anode substrate and forms a vacuum container together with the electron source substrate and the anode substrate; and a spacer which is arranged so as to be come into contact with the electron source substrate and the anode substrate and holds a distance between both of the substrates, wherein the spacer has an insulating substrate having concave and convex portions along a normal direction of both of the substrates and a high resistance film having a resistance lower than that of the insulating substrate and a rough surface corresponding to the concave and convex portions of the insulating substrate, and a thickness of high resistance film locating on each portion which crosses normal lines of both of the substrates among the concave and convex portions of the insulating substrate in at least a partial region of the spacer satisfies the following general equation (1)

$$t \geqq dp + \lambda \tag{1}$$

where, t: thickness of high resistance film (Å)

dp: primary electron penetration length (Å) $=m \times E^{n}$

λ: ionization electron diffusion length (Å) $=30/Q$

E : upper limit value of primary electron energy (keV)

m, n, Q: parameter constants which are experimentally obtained from characteristic of incident energy dependency δ(E) of secondary electron emission coefficient of spacer surface by the following general equations (2) and (3)

$$\delta = \frac{1}{4}P(Qm)^{-1}E^{1-n}\left[1-\left\{1+\left(\frac{1}{\gamma}-1\right)QmE^{n}\right]\exp(-QmE^{n})\right] \quad (2)$$

$$\gamma = 1 + \frac{0.68273}{(QmE^{n})^{0.86212}} \quad (3)$$

where,

P: parameter constant which is experimentally obtained from δ(E).

DETAILED DESCRIPTION OF THE PREFERRED EMBODIMENT

Figure 1:
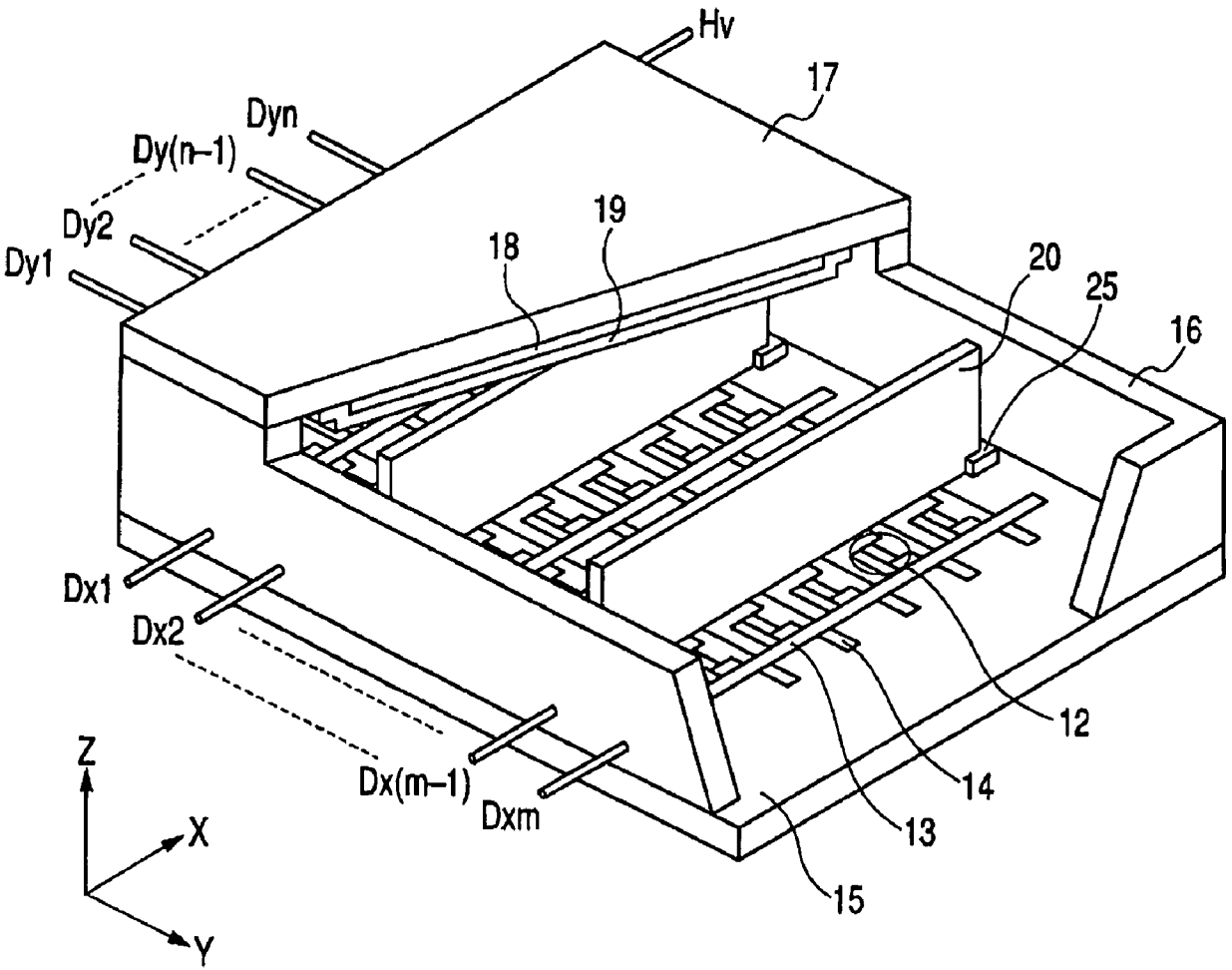
FIG. 1 is a perspective view schematically showing a construction of a display panel of an example of an image forming apparatus of the invention.

FIG. 1 schematically shows a construction of a display panel of an embodiment of an image forming apparatus of the invention FIG. 1 shows a perspective view with a part of the panel cut away in order to show an internal structure. In the diagram, reference numeral 12 denotes an electron-emitting device; 13 a row-directional wiring; 14 a column-directional wiring; 15 a rear plate (electron source substrate); 16 a frame member; 17 a face plate (anode substrate); 18 a phosphor film; 19 a metal back (anode electrode); 20 a spacer; and 25 a fixing member of the spacer.

In the invention, the rear plate 15 as an electron source substrate and the face plate 17 as an anode substrate are sealed in a peripheral edge portion through the frame member 16, thereby forming an airtight container. Since the inside of the airtight container is held in a vacuum of about $10^{-4}$ Pa, the spacer 20 in a rectangular thin plate shape is provided as an atmospheric pressure resistance structure in order to prevent a damage by the atmospheric pressure, sudden shock, or the like. In a region out of an image display region, an edge portion of the spacer 20 is fixed by the fixing member 25.

The N×M surface conduction electron-emitting devices 12 are formed on the rear plate 15 and arranged in a simple matrix by the M row-directional wirings 13 and N column-directional wirings 14 (M and N are positive integers). Crossing portions of the row-directional wirings 13 and the column-directional wirings 14 are insulated by an inter-layer insulating layer (not shown). In the embodiment, a construction in which the surface conduction electron-emitting devices are arranged in a simple matrix is shown. However, the invention is not limited to such a construction but can be also preferably applied to other electron-emitting devices of the field emission type (FE type), MIM type, and the like. The invention is not limited to the simple matrix layout.

In the construction of FIG. 1, the phosphor film 18 and the metal back 19 which is well known as an anode electrode in the field of a CRT are provided for the face plate 17. The phosphor film 18 is separately painted to phosphor of three primary colors of red, green, and blue, for example, in a stripe shape and a black electroconductor (black stripe) is provided between the phosphor portions of the respective colors. However, a layout of the phosphor portions is not limited to the stripe layout but may be another layout such as a delta-shaped layout or the like in accordance with a layout of the electron sources.

Figure 2:
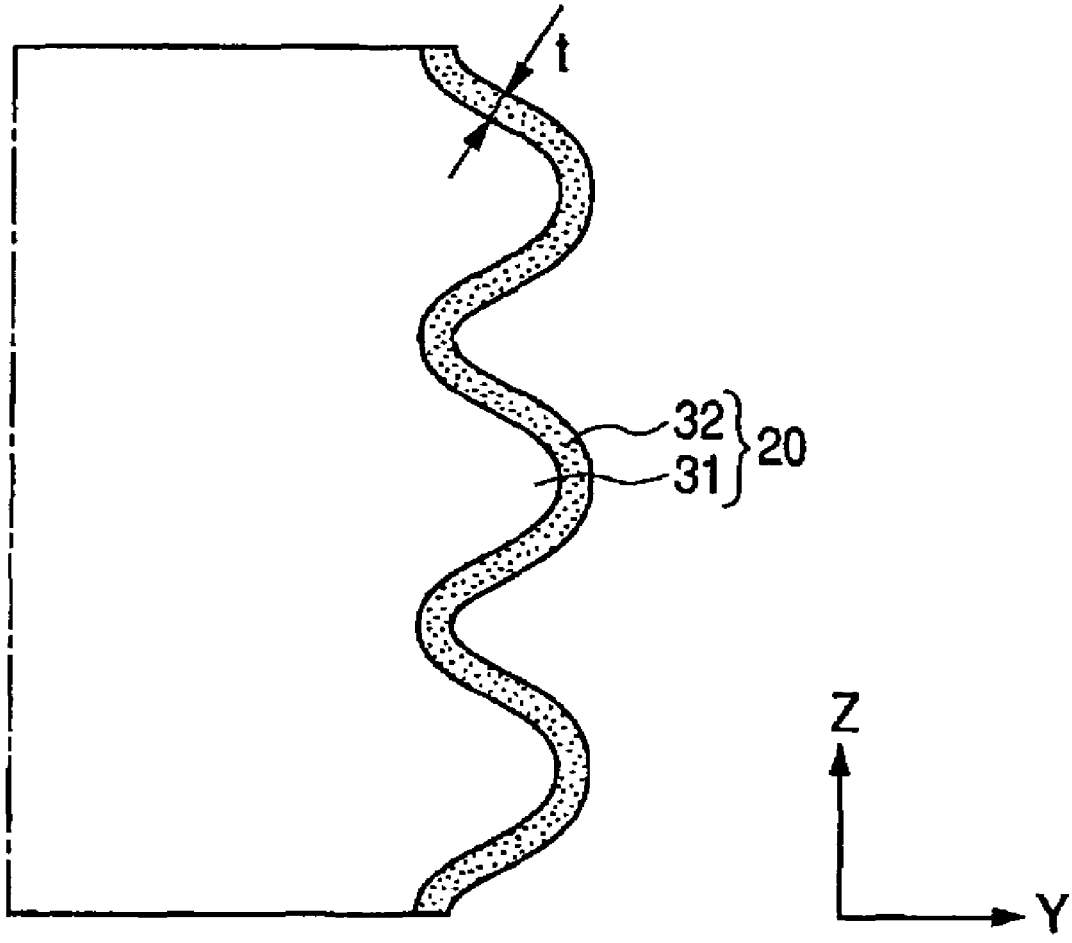
FIG. 2 is a partial cross sectional schematic view of an example of a spacer which is used in the invention.

FIG. 2 shows a partial cross sectional view of the spacer 20. From a viewpoint of suppressing the secondary electron emission, the spacer 20 which is used in the invention has concave and convex shapes on the side surfaces. The spacer 20 is constructed in such a manner that the surface of an insulating substrate 31 having concave and convex portions along the normal direction (that is, Z direction) of the face plate 17 and the rear plate 15 is coated with a high resistance film 32 which substantially reflects the concave and convex shapes. A resistance value of the high resistance film 32 is lower than that of the insulating substrate 31.

The spacer 20 which is used in the invention is arranged in parallel with the row-directional wiring 13 as a cathode electrode and electrically connected to the row-directional wiring 13 and the metal back 19 as an anode electrode.

A feature of the construction and the operation of the spacer 20 which is used in the invention will be described hereinbelow.

In the invention, in at least a partial region of the insulating substrate surface of the spacer, a thickness (t) of high resistance film on the slant surface of each of the concave/convex portions which cross the normal direction (Z direction in FIG. 2) of both of the substrates satisfies the following general equation (1).

$$t \geqq dp + \lambda \quad (1)$$

where, t: thickness of high resistance film (Å)

dp: primary electron penetration length (Å) =m×E $^{n}$

λ: ionization electron diffusion length (Å) =30/Q

E : upper Limit value of primary electron energy (keV)

m, n, Q: parameter constants which are experimentally obtained from characteristic of incident energy dependency δ(E) of secondary electron emission coefficient of spacer surface by the following general equations (2) and (3)

$$\delta = \frac{1}{4}P(Qm)^{-1}E^{1-n}\left[1-\left\{1+\left(\frac{1}{\gamma}-1\right)QmE^{n}\right]\exp(-QmE^{n})\right] \quad (2)$$

$$\gamma = 1 + \frac{0.68273}{(QmE^{n})^{0.86212}} \quad (3)$$

where,

P: parameter constant which is experimentally obtained from δ(E)

According to the examination of the inventors, it has been found that when the display apparatus is driven for a long time, the charging phenomenon of the surface of the spacer 20 having the rough surface relates to the penetration length (dp) of the primary electron which penetrates into the spacer and the thickness of high resistance film 32 formed on the spacer surface.

Figure 3:
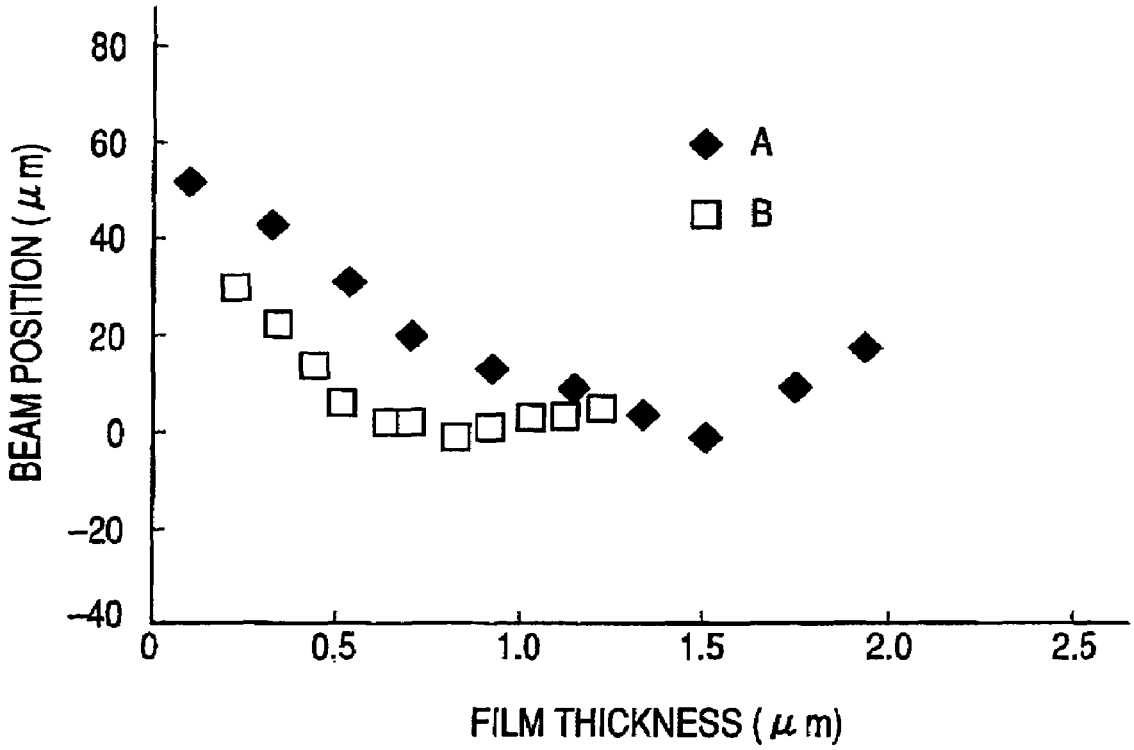
FIG. 3 is a diagram showing a relation between a primary electron penetration length and a thickness of high resistance film of the spacer surface.

Such a state is shown in FIG. 3. A sample (A) in the graph is obtained by a method whereby the surface of an insulating substrate (glass PD200) formed with concave and convex portions in which a concave/convex pitch is equal to 30 μm and a depth is equal to 10 μm is coated with a single layer of a high resistance film in such a manner that a sheet resistance lies within a range from $2\times10^{12}$ to $3\times10^{12}$ Ω/□ at 25° C. A sample (B) is obtained by a method whereby, on the same insulating substrate as that of the sample A, a second layer in which a sheet resistance lies within a range from $0.5\times10^{16}$ to $1\times10^{16}$ Ω/□ at 25° C. and is higher than that of the first layer by three digits or more is formed on the first layer in which the sheet resistance is equal to $3\times10^{12}$ Ω/□ at 25° C. and a film thickness is equal to 100 nm. There is a case where such a first layer is called an electric potential specifying layer hereinbelow. In the graph, an axis of ordinate indicates a beam position after the display apparatus is continuously driven for ten hours at an anode voltage of 10 kV and at a video rate of 60 Hz. The beam position is a beam position when a minimum electron current density on observation is given. The minimum electron current density on observation is an electron dose amount corresponding to the minimum pulse width and the minimum pulse height at the time of the ordinary device driving. An axis of abscissa indicates the film thickness of high resistance film. The film thickness of high resistance film in the sample (B) is a film thickness of high resistance film of the second layer.

In FIG. 3, assuming that a range where the beam position lies within a range from −5 μm to 5 μm is a level at which the charging characteristics are improved (background level), it will be understood that if the film thickness has a certain degree of thickness, displacement of the beam position can be prevented. According to the sample (A) with the single layer structure, if it is intended to obtain adequate characteristics, the film thickness of 1.2 μm or more is necessary. According to the laminated sample (B), it should be noted that it is sufficient to set the thickness of high resistance film (second layer) to a small value. However, also in the sample (B), it is considered that if the film thickness of second layer is too large, the carriers restricted in the second layer act as charging and exert an influence on the beam position. It is considered that this is because a time constant of charging relaxation of the second layer is high (long).

The present inventors have judged that in such a spacer that the lower layer as shown in a group of the samples (B) functions as an electric potential specifying layer and the upper layer functions as an electron penetration suppressing layer, the following elements are concerned as elements to decide the proper film thickness of the second layer (upper layer).

[Electron Penetration Length, Electron Penetration Mode, and Center of Gravity of Carrier Generation]

As shown in FIG. 2, in the spacer 20 in which the surface of the insulating substrate 31 is coated with the high resistance film 32, generally, the electron which entered the high resistance film 32 is subjected to an energy deactivating step described by the following general equation (5), loses an energy, and is finally stopped. A distance from the surface of the high resistance film 32 to the electron stop position is expressed by the primary electron penetration length (dp).

$$\frac{dE(x)}{dx} = \frac{A}{E^{n-1}} \tag{5}$$

where, n≧1.

In the above general equation (5), n=1 corresponds to a non-elastic scattering mode and a predetermined amount of energy is lost independent of the primary electron penetration length (dp). It is shown that when n>1, as the processing step approaches the end of the electron penetrating step, an electron deactivating energy per unit depth increases more.

When E (x)=0 is given as a boundary condition to the differential equation (5) in the penetration length dp=x, E (x) can be algebraically described as follows.

$$E(x)^n = An(d-x) \tag{6}$$

$$E(x)^{n-1} = \{An(d-x)\}^{(n-1)/n} \tag{7}$$

Therefore, the following general equation (8) is obtained from the general equations (5) and (7).

$$\frac{dE(x)}{dx} = -\frac{A}{E^{n-1}} = -\frac{A}{\{An(d-x)\}^{\frac{n-1}{n}}} \tag{8}$$

Assuming that a necessary energy in the generating step of the secondary electron in the medium is set to ξ, generation density distribution n(x) of the carriers in the medium per unit depth is expressed by the following general equation (9).

$$n(x) = -\frac{1}{\xi}\frac{dE(x)}{dx} = \frac{1}{\xi}\frac{A}{E^{n-1}} = \frac{1}{\xi}\frac{A}{\{An(d-x)\}^{\frac{n-1}{n}}} \tag{9}$$

Figure 4:
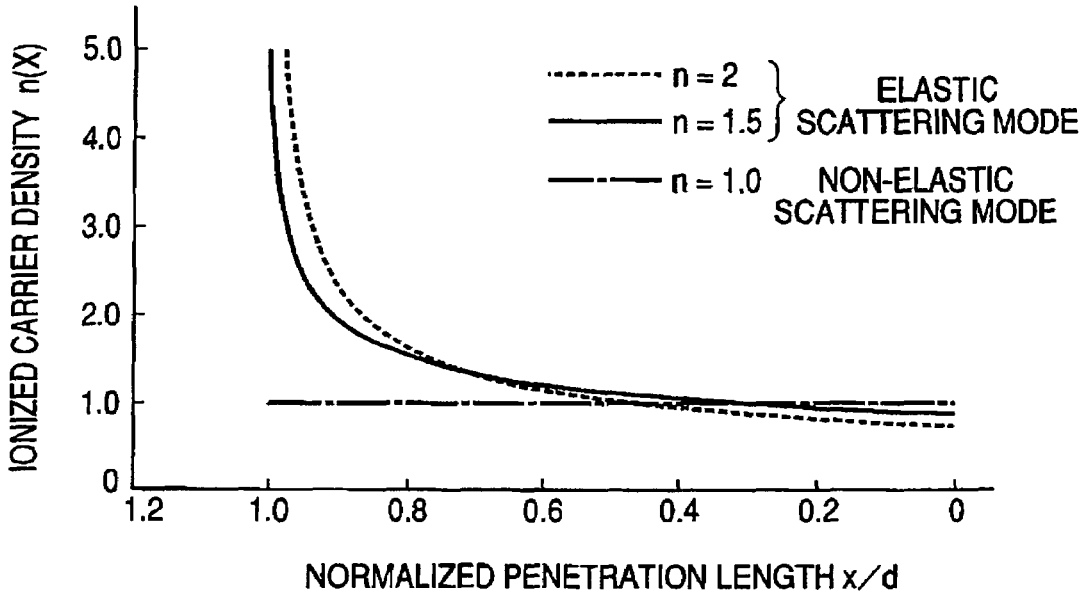
FIG. 4 is a diagram showing generation density distribution of carriers in a medium.

The generation density distribution of the carriers expressed by the general equation (9) is shown in FIG. 4. FIG. 4 shows a depth dependency profile of typical internal generation carrier density in a range from n=1 to n=2. In FIG. 4, only in the case of n=1, the number of generated electrons per unit depth is constant and the energy deactivating mode at the time of collision of the medium and the electron is a non-elastic scattering mode. When n>1, the number of generated electrons per unit depth has distribution for the depth. A maximum value of the n value on the definition is equal to 2 and, in this instance, the energy deactivating mode at the time of collision of the medium and the electron is an elastic scattering mode.

The n value in the general equation (9) is determined by measuring the characteristic of primary electron energy dependency [δ(E)] of the secondary electron emission coefficient, which will be explained hereinafter. Generally, the n value of the high resistance film material which is used for the spacer lies within a range of n=1 to 2 and this material is subjected to the energy deactivating step in which the elastic scattering and the non-elastic scattering are mixed. That is, it is presumed that such a film material shows a profile in which it has a peak near the penetration termination portion and the generation carrier density is higher in the deep portion as shown in a profile of n=1.5 or n=2 in FIG. 4.

The primary electron penetration length (dp) can be described by the following general equation (10).

$$dp = \frac{E^n}{An} \tag{10}$$

Both of the n value and the value of the An product in the general equation (10) can be decided by measuring the characteristic of primary electron energy dependency [δ(E)] of the secondary electron emission coefficient, which will be explained hereinafter. The decided penetration length (dp)

gives the generating region peak of the carriers which are generated in the high resistance film, that is, the center of gravity.

[Electron Diffusion Distance and Appearing Effect of Electric Potential Specifying Layer]

Since most of the carriers generated in the high resistance film are recombined with the electrons or holes existing in neighboring positions, they do not contribute to the charging of the spacer. However, a part of the carriers are not recombined with the electrons or holes but exist for a predetermined time and cause the charging. A continuation time of the charging depends on a time constant which is determined by a capacitive component C and a resistive component R of the film of the spacer surface. That is, particularly, the position of the penetration termination portion in the penetration region of the primary electrons is important to suppress the charging for a long time. When considering the case where the spacer is formed by the insulating substrate 31 and the high resistance film 32 as shown in FIG. 2, it is unpreferable that the penetration length (dp) reaches the insulating substrate 31 of the long time constant (the order of second or more). In other words, it is unpreferable that the primary electrons reach the insulating substrate. Since the ionization electrons are further diffused from the penetration termination portion, the thickness (t) of high resistance film 32 needs to satisfy the following relation in consideration of the ionization electron diffusion length (λ).

$$t \geqq \text{primary electron penetration length } (dp) + \text{ionization electron diffusion length } (\lambda) \quad (1)$$

In the invention, as shown in FIG. 2, in the portion of the slant surface of each of the concave/convex portions of the insulating substrate 31 which crosses the normal direction (Z direction) of the substrate, the thickness (t) of high resistance film 32 denotes a thickness in the normal direction of the slant surface of each of the concave/convex portions. This is true of a thickness (s) of high resistance region, which will be explained hereinafter. Those thicknesses are defined in consideration of a fact that when the film is formed, the film thickness of the slant surface of each of the concave/convex portions is more liable to become thinner than the other portion. It is desirable that the condition of the film thickness (t) is satisfied in the region of at least 50% in the normal direction of the substrate from the edge portion of the face plate side. This is because the influence on the spacer charging by the primary electron penetration is larger on the face plate side.

Further, as already described with reference to FIG. 3, it is desirable to form the film with the separated function in order to specify the electric potential of the spacer. Therefore, preferably, a low resistance region for specifying the electric potential is formed on the insulating substrate and a high resistance region for suppressing the electron penetration is formed on the low resistance region. At this time, when considering the ionization electron diffusion length (λ) in the high resistance region, it will be understood that it is preferable to set the film thickness (s) of high resistance region for suppressing the electron penetration by using the film thickness corresponding to [primary electron penetration length (dp)+ ionization electron diffusion length (λ)] as a lower limit value. That is, $$dp+\lambda \geqq s \quad (4)$$

Since the ionization electron diffusion length (λ) reaches the low resistance region, the ionization electrons are rapidly relaxed in the low resistance region and the charging charges can be suppressed. That is, a probability that the ionization electrons remain in the high resistance region can be reduced. More preferably, s>dp.

The ionization electron diffusion length (λ) can be described by measuring the characteristic of incident energy dependency [δ(E)] of the secondary electron emission coefficient, which will be explained hereinafter, by its description parameter Q (absorption coefficient). According to the examination by the present inventors, it has been found that it is preferable that the value which is 30 times as large as the distance (Å) that is given by a reciprocal number of Q is set to the diffusion length.

[Measuring Method of Secondary Electron Emission Coefficient (δ) and its Characteristic of Incident Energy Dependency δ(E)]

The secondary electron emission coefficient (δ) and its characteristic of incident energy dependency δ(E) of the secondary electron emission coefficient are measured by the following method.

First, the secondary electron emission coefficient (δ) is measured by using a general scanning electron microscope (SEM) equipped with an electron ammeter. The primary electron current is measured by using an ammeter equipped with a Faraday cup collector. The emission secondary electron current amount is measured by using an ammeter equipped with a collector (an MCP or the like can be also used) as a detector. The secondary electron emission coefficient (δ) may be also obtained from a sample current and the primary electron current by using a relation of a continuity rule of the sample current passing through a sample portion, the primary electron current, and the emission secondary electron current. Generally, in the case of observing the emission secondary electron current amount by using the medium whose volume resistance is equal to or larger than $1\times10^4$ Ωcm as a target to be measured, there is a possibility that the secondary electron current amount has a measurement error as a too-small value in the case of positive charging and as an excessive value in the case of negative charging due to the local charging near the primary electron irradiating region. Therefore, it is desirable to input the primary electrons having a pulse width on the order of msec and eliminate the influence of the charging due to the continuous irradiation. The primary electrons having a pulse width of 10 msec were used for the actual measurement in the invention.

The characteristic of incident electron energy dependency [δ(E)] of the secondary electron emission coefficient was measured by setting an angle of incident of the primary electrons to 90°, that is, under a vertical incident condition. If the incident angle condition of 90° cannot be obtained due to the reason for a shape or the like of the target to be measured, a parameter obtained by replacing the Q parameter in the general equation (2) with Q cos θ (θ: incident angle) is used as a regression function and the secondary electron current amount is actually measured at the predetermined incident angle θ, so that such a characteristic can be obtained. A method of deciding the Q value, m value, and n value which are necessary for describing the feature of the spacer high resistance film used in the invention will be described hereinbelow.

In the general equation (2), as for the characteristic of incident energy dependency of the secondary electron emission coefficient, an incident energy E is used as a variable and the values of the indefinite constants P, Q, m, and n are determined by the method of least squares. That is, four or more pairs of actual measurement results (δi value, Ei value: i value=1, 2, 3, 4) having at least the different incident energies are used and the regression analysis is made by using the general equation (2) as a regression analysis model equation, so that the values of the indefinite constants P, Q, m, and n can be determined. Since there are the four indefinite parameters, at least four measuring points of the incident energies upon actual measurement are necessary. However, generally, since the larger the number of measuring points is, the smaller the error amount due to the regression process of the deciding parameters is, it is proper to set about 6 to 10 measuring points. In this instance, it is desirable to set many measuring conditions into the energy range of about 0 to 3 keV where a characteristics change for the incident electron energy is large. It is also desirable that the incident electron energy corresponding to an accelerating voltage of the image forming apparatus is included in the measuring region. A vacuum degree is set to $10^{-5}$ Pa or less and the measurement is performed at the room temperature (25° C.).

Figure 5:
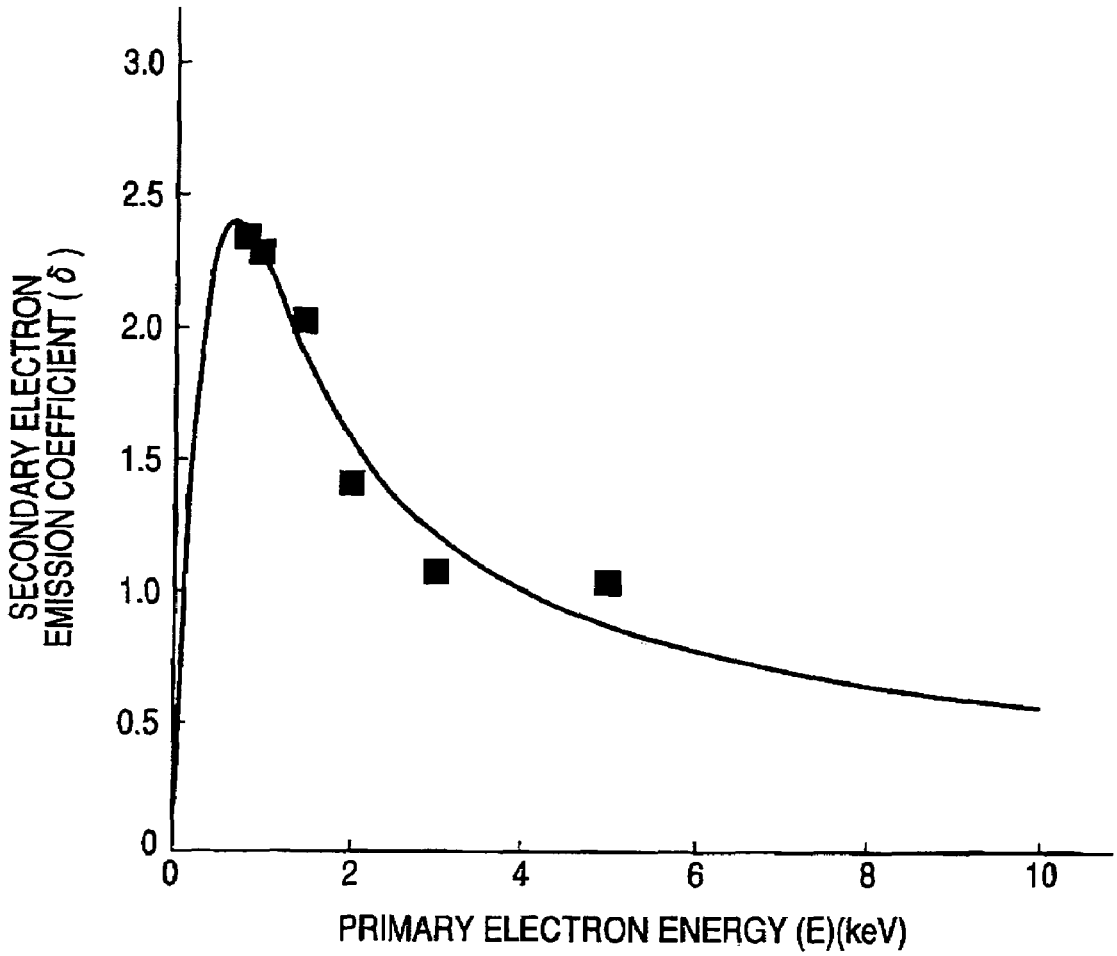
FIG. 5 is a diagram showing a measurement example of a characteristic of incident energy dependency δ(E) of secondary electron emission coefficient according to the invention.

FIG. 5 shows a measurement example of the characteristic of incident energy dependency [δ(E)] of the secondary electron emission coefficient and a numerical value example of the parameters obtained therefrom.

As an insulating substrate of the spacer which is used in the invention, for example, quartz glass, glass in which an impurities content of Na or the like is reduced, soda-lime glass, a ceramics material such as alumina, or the like can be mentioned. It is preferable to use a material whose coefficient of thermal expansion is close to that of the material constructing an airtight container. As a high resistance film which is coated onto the insulating substrate, it is preferable to select the film whose sheet resistance value lies within a range from $1\times10^{8}$ to $1\times10^{15}$ Ω/□ in any of the case of the single layer and the case of the film having the low resistance region and the high resistance region. In the case of providing the low resistance region and the high resistance region, it is preferable to construct so that the resistance value of the high resistance region is larger than that of the low resistance region by 10 or more times. As a material of such a high resistance film, it is desirable to use a material containing a metal element whose atomic number is equal to or larger than 37 (rubidium) of 3 atomic % or more or a material containing an oxide or nitride of an element whose atomic number is equal to or larger than 32 (germanium) as a main component. Specifically speaking, as a former metal whose atomic number is equal to or larger than 37 mentioned above, W (tungsten), Pt (platinum), Au (gold), Pd (palladium), Ru (ruthenium), or the like is preferably used. As latter oxide or nitride of an element whose atomic number is equal to or larger than 32, $Ge_3N_4$ (germanium nitride), $SnO_2$ (tin oxide), or the like is preferably used. However, a stoichiometrical composition ratio is not limited to the above-mentioned values. The high resistance film can be formed by one of a sputtering method, a vacuum evaporation depositing method, wet printing, a spraying method, and a dipping method. In the invention, it is also possible to form a film of a higher resistance value, for example, an insulating carbon film or the like onto the further front surface side of the high resistance film having the low resistance region and the high resistance region, thereby suppressing an escape probability of the secondary electrons (that is, reducing the secondary electron emission coefficient).

The thickness of high resistance film is measured by the following method. That is, a cutting surface obtained by cutting the film in the direction perpendicular to the spacer surface is exposed. The film thickness can be measured by the sectional SEM at the cutting surface. In the case of evaluating by the sectional SEM, by providing the sputtering coating of a thin metal film as a pre-process, local charge-up due to the insulation performance of a sample can be suppressed.

In the invention, it is necessary that the roughness of the insulating substrate surface of the spacer has a shape along at least the normal direction (Z direction) of the substrate. It is sufficient that it has a shape along such a direction as to reduce the characteristic of incident energy dependency of the secondary electron emission coefficient for each of the trajectory of the electron beam from the electron source and the trajectory of the electron beam reflected by the anode electrode. Therefore, a line shape which is parallel with the substrate is preferably used. In additional to such a direction, such a rough surface may be formed along the X direction. In this case, the concave and convex portions are formed in a dot shape on the spacer surface. It is preferable to set an average period of the concave and convex portions to 100 μm or less, and more preferably, 10 μm or less. It is preferable to set an average surface roughness to a value within a range from 0.1 μm or more to 100 μm or less, and more preferably, 1 μm or more to 10 μm or less.

The cross sectional shape of the concave and convex portions on the spacer surface according to the invention is not particularly limited. Besides the waveform as shown in FIG. 2, a trapezoid, a rectangle, a triangle, or the like may be properly used. Further, a plurality of shapes may be combined. It is also possible to use a construction in which the surface is made rough by allowing particles to be distributed and contained in a binder matrix. Porous glass or porous ceramics may be used.

The spacer according to the invention is in contact with the anode electrode and the electron source and an electroconductive film may be also additionally formed on the contact surface.

Although the spacer shown in FIG. 1 has a thin rectangular plate shape and is preferably used in the invention, the invention is not limited to such a shape. A columnar shape or the like can be properly selected within the scope where a similar effect is obtained.

EXAMPLES

Example 1

The spacers which are used in the invention are manufactured as follows.

A substrate (PD200 made by Asahi Glass Co., Ltd.) is used as a base material and worked into a proper shape by a heat drawing method and a resultant plate is prepared as an insulating substrate of the spacer. The substrate has dimensions of (1.7 mm×0.18 mm×820 mm) and convex portions whose cross sectional shape is an almost trapezoid and whose average height is equal to 8 μm are formed at a pitch of 30 μm on the surface of (820 mm×1.7 mm) (hereinafter, referred to as a side surface). Surfaces of (0.18 mm×820 mm) (hereinafter, referred to as a contact surface) are formed in a flat shape so as to be come into contact with the cathode (upper wirings) and the anode (metal back). A corner between the side surface and the bottom surface is formed in a round shape so as to minimize the chipping and its radius of curvature is set to 5 μm. The concave and convex portions and the round shape of the corner portion are drawn so as to maintain the shapes which are almost similar to the shape of base material glass before it is drawn. Thus, in the assembled state, they are formed in such a manner that each shape is drawn in the direction which is parallel with the face plate and the rear plate.

Cleaning Step:

After ultrasonic cleaning and rinse are executed with pure water, IPA (isopropyl alcohol), and acetone, warm air drying is executed, so that the cleaned substrate is obtained. Subsequently, the high resistance films are formed on the four surfaces other than the surfaces of (1.7 mm×0.18 mm).

High Resistance Film Forming Step:

The high resistance film is formed on the insulating substrate by the RF sputtering method. High resistance films 1 are formed on the four surfaces comprising the side surfaces and the contact surfaces. High resistance films 2 are further formed on the two side surfaces and a spacer coated with the stacked high resistance films is formed. The films are formed so that the resistance value of the high resistance film 2 is larger than that of the high resistance film 1 by 10 or more times. As a high resistance film 1, PtAlN having a film thickness of 40 nm is formed so that the sheet resistance after the film was formed is equal to $2.5\times10^{12}$ Ω/□ at 25° C.

Table 1 shows actual measurement values of the resistance values and film thicknesses at 25° C. of high resistance films 2 used in this Example and the parameters regarding an interaction of the electrons and the high resistance films 2, respectively. The parameter Q is an electron absorption coefficient $\Delta^{-1}=\times10^{10}$ $m^{-1}$ in the medium, m the constant which is proportional to a reciprocal number of the electron density, and n the parameter describing a penetration mode in the medium of the penetration primary electrons.

Upon measurement, the high resistance film 2 is, formed on the smooth substrate so as to have a film thickness of 10 μm and the characteristic of primary electron energy dependency [δ(E)] of the secondary electron emission coefficient is measured by the foregoing measuring method.

TABLE 1

| No. of high resistance film 2 | Composition element | Sputtering target | Volume resistance At 25° C. (Ω, cm) | Q | m | n |
|---|---|---|---|---|---|---|
| 2-1 | WGeNO | GeW | $2.16\times10^{10}$ | 0.03 | 68 | 1.75 |
| 2-2 | WGeNO | Ge/W Sintered Body | $5.29\times10^{9}$ | 0.0299 | 60 | 1.81 |
| 2-3 | CrGeNO | GeCr | $1.69\times10^{10}$ | 0.036 | 51 | 1.75 |
| 2-4 | PtAlN | Al/Pt Sintered body | $2.59\times10^{10}$ | 0.0265 | 65 | 1.85 |
| 2-5 | PtAlN | AlPt | $5.41\times10^{10}$ | 0.0245 | 73 | 1.90 |

Table 2 shows a construction of the spacer of this Example in which each high resistance film 2 in Table 1 is formed on the high resistance film 1 on the side surface of the insulating substrate.

The image forming apparatuses with the construction shown in FIG. 1 are manufactured by using spacers 1-1 to 1-5 of this Example and driven. Thus, even if the apparatus using any one of those spacers was driven for a long time, a positional deviation of the electron beam-near the spacer is not found. Further, it has been confirmed that, even in the depth region of the high resistance film on the spacer surface, the residual charges are effectively suppressed and the electric potential specification by the current flowing in the spacer is satisfied.

In the Example, the high resistance films 1 and the high resistance films 2 are formed so that their characteristics values (for example, electric resistance, composition ratio) are discontinuous in the film thickness direction. However, the invention is not limited to such an example but they can be also formed so as to obtain the characteristics values which are continuous in the film thickness direction so that the relation between the effective electron penetration distance and film thickness which take the electron diffusion length (λ) into consideration appears equivalently. In this instance, it is sufficient that a virtual boundary at which an effective sheet resistance is equivalent when an internal sheet resistance is 0.1 as large as the sheet resistance of an external region is handled as a thickness of high resistance film 2. The forming method of the high resistance films is not particularly limited to a coating process such as printing, ion doping to the insulating substrate, or the like.

Example 2

The spacer is formed and the image forming apparatus is constructed and driven in a manner similar to Example 1 except that the electrodes made of Pt are formed on the bottom surfaces (that is, two positions of the surfaces of 0.18 mm×820 mm) of the spacer. Thus, even if the apparatus is driven for a long time, a positional deviation of the electron beam near the spacer is not found. Further, it has been confirmed that, even in the depth region of the high resistance film on the spacer surface, the electric potential specification by the current field of the spacer is satisfied.

Example 3

The spacer is formed and the image forming apparatus is constructed in a manner similar to Example 1 except that insulating layer (volume resistance at 25° C.: $3\times10^{11}$ Ωcm or more) of amorphous carbon is stacked and formed on the surface of the high resistance film so as to have a thickness of 10 nm. Thus, even if the apparatus is driven for a long time, a positional deviation of the electron beam near the spacer is not found. It has been confirmed that, even in the depth region of the high resistance film on the spacer surface, the electric potential specification by the current field of the spacer is satisfied.

TABLE 2

| Spacer No. | Sheet resistance ratio (high resistance film 2/ high resistance film 1) | Average film thickness of high resistance film 2 | Sheet resistance value of high resistance film 2 | dp at 11 kV (Å) | Dp + λ (Å) | s (Å) | t (Å) |
|---|---|---|---|---|---|---|---|
| 1-1 | 100 | 9200 | $2.35\times10^{14}$ | 4520 | 5520 | 5336 | 6296 |
| 1-2 | 30 | 8000 | $7.06\times10^{13}$ | 4600 | 5610 | 5600 | 5984 |
| 1-3 | 120 | 6000 | $2.82\times10^{14}$ | 3390 | 4220 | 3600 | 5040 |
| 1-4 | 100 | 14000 | $2.35\times10^{14}$ | 10130 | 1127 | 11200 | 11776 |
| 1-5 | 200 | 11500 | $4.71\times10^{14}$ | 6890 | 8120 | 8050 | 8338 |

In Table 2, the primary electron penetration length (dp) is determined by m, n, and E (upper limit value of the primary energy=anode accelerating voltage Va [V]).

$$dp[Å]=m\times Va^{n}$$

A film density of the WGeN film of each of the high resistance films 2 of the spacers 1-1 and 1-4 in Example 1 is equal to 16 g/cm$^3$ and a film density of the high resistance film 1 (PtAlN film) of the first layer is equal to 9.1 g/cm$^3$. The film density is obtained by measuring the RBS: Rutherford Backscattering Spectrometory to determine the m value.

A method of deciding m value is obtained from the film densities will be described hereinbelow.

As a characteristic of energy dependency of the secondary electron emission coefficient, the measurement is performed by the energy values at five or more measuring points in a range including the peak on the low energy side and the regression analysis is made by using the general equation (2) as a regression analysis model equation. The parameter m value should be obtained by means other than secondary electron emission measurement. The film density can be described by the m value by the Bronshtein's range energy relational equation $$dp(\text{Å})=520\times A(Zeff)/\rho/Zeff\times E^{n}$$

This equation is disclosed in K. I. Grais, A. M. Bastawros, J. Appl. Phys. 53, 5293 (1982) and the foregoing dp: primary electron penetration length (Å) =m×E $^{n}$ Therefore, the parameter m value is obtained from the relation of $$m=520\times A(Zeff)/Zeff/\rho$$

where ρ(g/cm$^3$) is specific gravity as film density.

on the basis of the ratio between an effective atomic amount A(Zeff) obtained from the composition ratio of the film and an effective atomic number Zeff.

In the invention, it is more preferable that a film whose specific gravity is higher than that of the high resistance film 1 is used as a high resistance film 2. Thus, a process tact can be raised without setting the necessary film thickness of high resistance film 2 to an excessive thick value by suppressing the effective electron penetration length, and a film peel-off or the like can be suppressed by suppressing the residual stress of the film on the insulating substrate due to the thick film thickness.

In the case where the method of measuring the characteristic of RBS: Rutherford Backscattering Spectrometory cannot be used, for example the restriction of the support substrate, the film density may be also decided from a combination of the measuring the weight and thickness of the film or another composition analysis.

In this Example, when the high resistance film which has preliminarily been confirmed that the electron density is large is formed on the second layer (outside where the primary electrons are penetrated from the first layer whose electric potential can be specified), the film thickness can be reduced and the manufacturing time and the tact can be suppressed. In this Example, the film thickness of the spacer 1-1 is 1.5 times as large and the film forming speed thereof is about 3 times as high as those in the case of the working time of the second layer of the spacer 1-5 in Example 1, so that the efficiency can be improved and the film forming time of the second layer can be suppressed by up to 22%.

From the above points, it is desirable that the high resistance film 2 contains a metal element whose atomic number is equal to or larger than 37 by 3 atomic % or more in the normal direction of the slant surface of each of the concave/convex portions of the substrate or contains oxide or nitride of an element whose atomic number is equal to or larger than 32 as a main component.

The high resistance, film 2 of this Example is in the elastic scattering penetration mode in which the n value lies within a range from 1.5 or more to 2 or less at an anode applying voltage (accelerating voltage) Va=11 kV upon operation. Therefore, the interaction between the penetration electrons and the high resistance film of the spacer is more active in the penetration deep portion. Thus, in the internal high resistance film 1 having a relatively low resistance value, most of the ionized carriers can be efficiently neutralized.

According to the invention, both of the short-time charging of the spacer and the cumulative charging are suppressed and the displacement of the electron beam due to those charging is prevented. Consequently, the image display apparatus which provides a preferable image display for a long time and in which the high reliability and durability are obtained is provided.

This application claims priority from Japanese Patent Application No. 2004-356502 filed Dec. 9, 2004, which is hereby incorporated by reference herein.

What is claimed is:

1. An image forming apparatus comprising:

an electron source substrate having a plurality of electron-emitting devices and wirings to apply voltages to said electron-emitting devices;

an anode substrate which is arranged so as to face said electron source substrate and has light emitting members each of which emits light by irradiation of an electron emitted from each of said electron-emitting devices and an anode electrode;

a frame which exists in peripheral portions of said electron source substrate and said anode substrate and forms a vacuum container together with said electron source substrate and said anode substrate; and a spacer which is arranged so as to become into contact with said electron source substrate and said anode substrate and holds a distance between both of said substrates, wherein said spacer has an insulating substrate having concave and convex portions along a normal direction of said electron source substrate and said anode substrate and a high resistance film having a resistance lower than that of said insulating substrate and a rough surface corresponding to the concave and convex portions of said insulating substrate, and a thickness of high resistance film locating on each portion which crosses normal lines of said electron source substrate and said anode substrate among the concave and convex portions of said insulating substrate in at least a partial region of said spacer satisfies the following general equation (1)

$$t\geqq dp+\lambda \quad (1)$$

where, t: thickness of high resistance film (Å)

dp: primary electron penetration length (Å) =m×E$^{n}$

λ: ionization electron diffusion length (Å) =30/Q

E: upper limit value of primary electron energy (keV)

m, n, Q: parameter constants which are experimentally obtained from characteristic of incident energy dependency δ(E) of secondary electron emission coefficient and specific gravity of spacer surface by the following general equations (2), (3) and (11)

$$\delta = \frac{1}{4}P(Qm)^{-1}E^{1-n}\left[1-\left\{1+\left(\frac{1}{\gamma}-1\right)QmE^{n}\right]\exp(-QmE^{n})\right] \quad (2)$$

$$\gamma = 1 + \frac{0.68273}{(QmE^{n})^{0.86212}} \quad (3)$$

$$m = 520 \times A(Zeff) / Zeff / \rho \quad (11)$$

where ρ (g/cm$^3$) is specific gravity as film density, on the basis of the ratio between an effective atomic amount A (Zeff) obtained from the composition ratio of the film and an effective atomic number Zeff, where, P: parameter constant which is experimentally obtained from said δ(E).

2. An apparatus according to claim 1, wherein the region which satisfies said general equation (1) is a region which is 50% or more in the normal direction of said anode substrate from an edge portion of said spacer which is come into contact with said anode substrate.

3. An apparatus according to claim 1, wherein the high resistance film of said spacer has at least two regions of a low resistance region locating on the insulating substrate side and a high resistance region locating in an outer side of the high resistance film and a thickness (s) of high resistance region locating on each portion which crosses the normal lines of said electron source substrate and said anode substrate among the concave and convex portions of said insulating substrate satisfies the following general equation (4)

$$dp+\lambda \geqq s \quad (4).$$

4. An apparatus according to claim 1, wherein a sheet resistance value of the high resistance film of said spacer lies within a range from $1\times10^{8}$ to $\times10^{15}$ Ω/G.

* * * * *